US005511805A

United States Patent [19]

McGrath

[11] Patent Number: 5,511,805

[45] Date of Patent: Apr. 30, 1996

[54] BRAKING APPARATUS FOR USE WITH IN-LINE ROLLER SKATES

[76] Inventor: Neal McGrath, 12 Horseshoe La., Lamont, Ill. 60439

[21] Appl. No.: 242,111

[22] Filed: May 12, 1994

[51] Int. Cl.[6] ..... A63C 17/14

[52] U.S. Cl. ..... 280/11.2; 280/11.22

[58] Field of Search ..... 280/11.2, 11.22, 280/11.23, 11.21; 188/1.12, 29, 80, 71.1

[56] References Cited

U.S. PATENT DOCUMENTS

| | | | |
|---|---|---|---|
| 255,694 | 3/1882 | Taylor | 280/11.2 |
| 2,725,238 | 11/1955 | Day | 280/11.2 |
| 2,865,645 | 12/1958 | Levin . | |
| 3,224,785 | 12/1965 | Stevenson | 188/29 |
| 3,734,244 | 5/1973 | Roddy . | |
| 3,900,203 | 8/1975 | Kukulowicz | 280/11.2 |
| 4,128,144 | 12/1978 | Vassar | 188/1.12 |
| 4,526,389 | 7/1985 | Chase | 188/80 |
| 5,135,244 | 8/1992 | Allison | 280/11.28 |
| 5,143,387 | 9/1992 | Colla | 280/11.2 |
| 5,171,032 | 12/1992 | Dettmer | 280/11.2 |
| 5,226,673 | 7/1993 | Cech | 280/11.2 |
| 5,232,231 | 8/1993 | Carlsmith | 280/11.2 |
| 5,239,941 | 8/1993 | Chibi | 280/11.2 |
| 5,275,472 | 1/1994 | Hicks | 188/1.12 |

*Primary Examiner*—Brian L. Johnson
*Attorney, Agent, or Firm*—Arnold, White & Durkee

[57] ABSTRACT

A braking device for use in an in-line roller skate includes at least one braking member. Braking members are positioned relative to the skate wheels allowing the braking members to engage the circumference of at least one skate wheel. The degree of contact between the braking members and the skate wheels is variable to allow a skater to gain proficiency with reduced risk of sustaining injury. The braking device is easily removable from the skate.

3 Claims, 2 Drawing Sheets

BRAKING APPARATUS FOR USE WITH IN-LINE ROLLER SKATES

BACKGROUND OF THE INVENTION

1. Field of the Invention

The present invention relates to in-line roller skates, and particularly to an infinitely adjustable removable braking device for use with in-line roller skates.

2. Background

In recent years in-line roller skates have become popular with both experienced skaters and novices. However, learning to master in-line skates is difficult because of the general structure of in-line skates, which requires the skater to have the ability to control the rolling motion of traditional roller skates and the ability to balance on a single line similar to traditional ice skates. During the typical learning process for in-line skates, skaters tend to lose balance and control because of the quick rolling action of the in-line wheels. Consequently, beginning in-line skaters fall often and may lose interest in the sport before attaining proficiency.

A variety of braking devices have been developed for roller skates to allow beginning skaters to control their speed until they feel comfortable on skates. These known braking devices employ various arrangements of brake pads, disks, or flanges which contact one or more wheels of the roller skate. Known braking devices are mechanically complex and difficult to attach to or remove from the skate. One known braking device uses a complex cable system and requires the skater to hold one or more actuators in his hand frustrating a skater's ability to use his arms to maintain his balance.

As a result, there is a need for a braking device which can be easily installed on in-line skates, conveniently adjusted by the skater to retard the motion of the wheels, and easily removed from the skates after skating proficiency is achieved.

SUMMARY OF THE INVENTION

The present invention is a braking device for use with in-line skates. The braking device of the present invention is self-contained and may be installed easily on known types of in-line skates.

The braking device applies a constant and infinitely adjustable braking force to one or more wheels of the skate. As used herein, the term "infinitely adjustable" is intended to mean that the invention allows total control of the degree of movement of the wheels of the in-line skate. The braking system of the present invention may be employed to maintain the wheels in a fixed position if desired to allow a beginning skater to become comfortable with the feel of in-line skates by walking in the in-line skates with the wheels held stationary. As the skater gains confidence, the braking action of the invention may be gradually reduced by means of a simple adjustment, thereby allowing the wheels of the in-line skate to increase rotational movement in proportion to the reduction in braking. Finally, when the skater attains proficiency, the braking mechanism is easily removed.

The braking device is positioned between the sole of the skate and the wheels and is held in position by the structural parts of the skate itself. Therefore, the braking device can be included as part of the skate during the original manufacture without requiring any design changes to the skate itself. In addition, the braking device can be sold in the after-market and simply installed by the skater. Due to the free standing position of the braking device between the sole of the skate and the wheels and due to the structure of the braking device, it is self-aligning around a wheel of the in-line skate. Because the braking device is not permanently secured to the skate itself and is self-aligning, it is easily installed or removed for use with another pair of skates.

The present invention comprises at least one braking member which engages the circumference of at least one of the wheels of a skate. The number of braking members employed in the braking apparatus of the present invention is a matter of design choice. If more braking members are employed, more wheels of the in-line skate may be contacted resulting in the ability to retard the rotation of a greater number of the wheels. Thus, the number of wheels upon which braking control is exerted by the braking device of the present invention is increased by increasing the number of braking members.

In a preferred embodiment, the braking device comprises two cylindrical braking members for an in-line skate having four wheels. The braking members are mounted on axles which are in turn mounted near opposite ends of a first U-shaped bracket and are spaced apart so that each braking member engages two in-line skate wheels when the braking device is positioned over one of the wheels of the in-line skate. The first U-shaped bracket is fitted into a second U-shaped bracket and the combination fits within the wheel support structure of an in-line skate.

A wedge is positioned between the two U-shaped brackets and is adjustable by means of a screw. The movement of the screw alters the position of the wedge which increases or decreases the downward pressure on the first U-shaped bracket and increases or decreases the resistance imparted to the wheels of the in-line skate.

DESCRIPTION OF THE PREFERRED EMBODIMENTS

Figure 1:
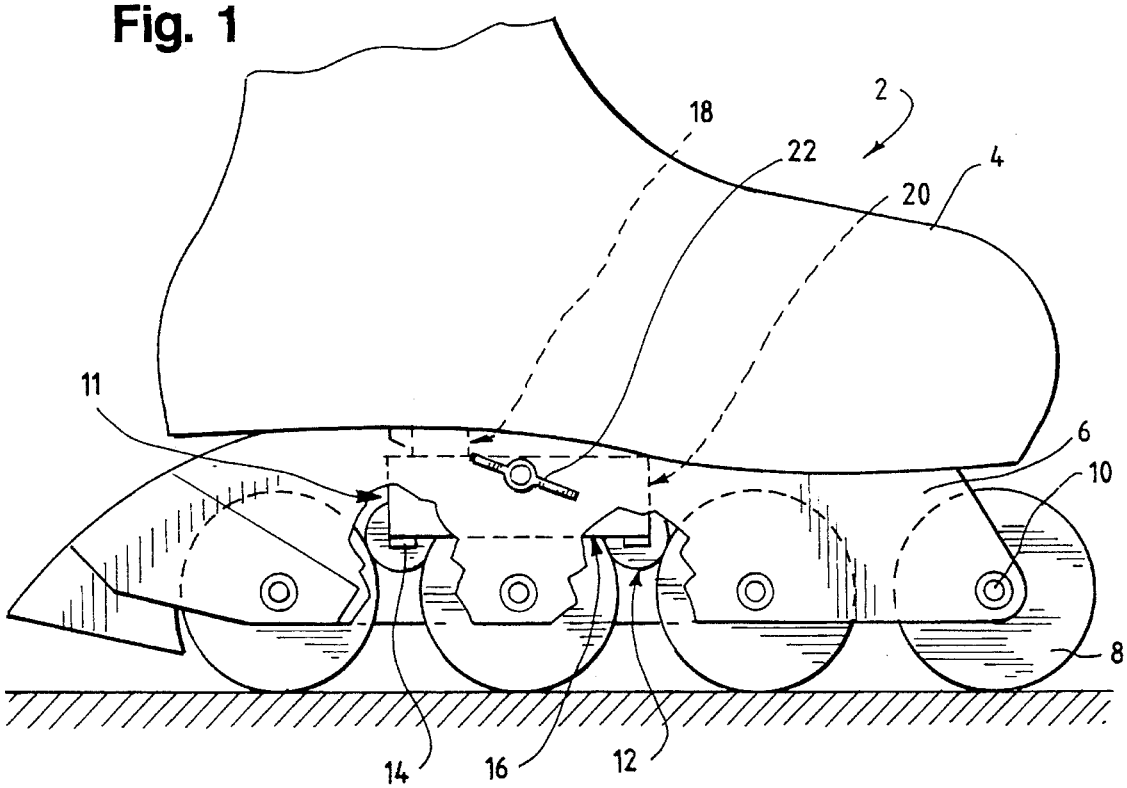
FIG. 1 is a side view of an in-line skate with a cut-away portion to show part of the brake according to the preferred embodiment of the invention.

FIG. 1 shows a side view of an in-line skate 2. The in-line skate 2 comprises a boot 4 and a wheel support structure 6. Four wheels 8 are secured in the wheel support structure 6 by axles 10. Of course, the number of wheels can be increased or decreased in accord with design considerations and does not change the application of the present invention. A braking device 11 according to the present invention is positioned within the wheel support structure 6, above the wheels 8 and below the boot 4. Two braking members 12 are shown to be rotationally engaging three of the four wheels 8. In a preferred embodiment, the braking members 12 are cylindrical. Those of ordinary skill in the field will recognize, however, that the braking members 12 may be of any suitable shape, including structures having convex or concave outer walls. In addition, the number of braking members can be increased or decreased without departing from the teachings of the present invention.

The braking members 12 are rotationally mounted within a first U-shaped bracket 14. The first U-shaped bracket 14 is fitted inside a second U-shaped bracket 16 having an arch support 18. The entire braking device 11 fits within the support structure 6 of the in-line skate 2. The arch support 18 and one end 20 of the second U-shaped bracket 16 press against the bottom of the boot 4 when the braking device 11 is operated to exert resistance on at least some of the wheels 8 via the braking members 12. The amount of braking force exerted by the braking device 11 is varied by turning an adjusting knob 22 which protrudes from the second U-shaped bracket 16.

The present invention is easily inserted into and removed from the support structure 6 of an in-line skate 2. The braking device 11 is not physically attached to the in-line skate. The braking device 11 is maintained in position by the wheel support structure 6, the interaction of the braking members 12 and the wheels 8, and the interaction of the arch support 18, one end 20 of the second U-shaped bracket 16, and the bottom of the boot 4. By separating the center of the braking members 12 by a distance approximating the distance between the axles 10 of two adjacent wheels 8, the present invention becomes self-aligning around one wheel 8 of the in-line skate 2.

Figure 2:
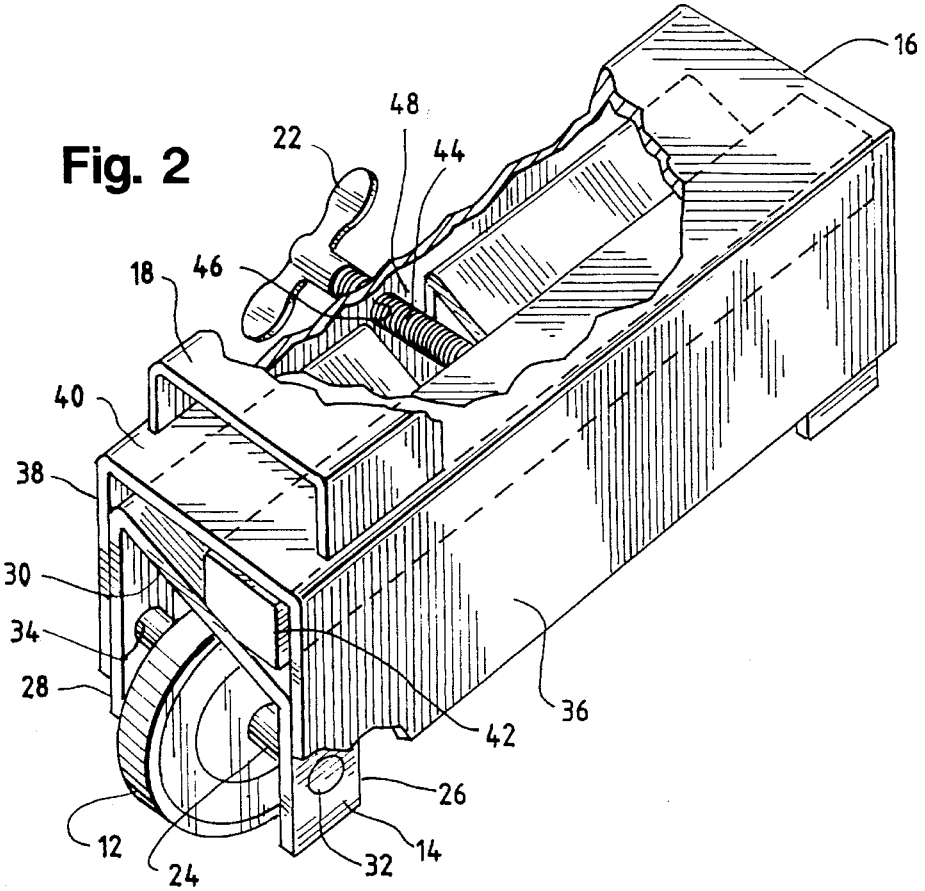
FIG. 2 is a partially cut-away three-dimensional view of the braking device of the invention.

FIG. 2 depicts a three-dimensional view of a preferred embodiment of the braking device 11. A cylindrical braking member 12 is rotationally mounted on an axle 24. A first U-shaped bracket 14 has two substantially parallel sides 26 and 28 connected in a non-perpendicular manner by a base side 30. Axle 24 is rotationally mounted in the first U-shaped shaped bracket 14 via holes 32 and 34. While the braking member described above is designed to rotate, it is recognized that a non-rotating braking member may be alternatively utilized. Likewise it is recognized that when the braking member is non-rotating, a non-cylindrical shaped braking member may be substituted for a cylindrical braking member.

The first U-shaped bracket 14 is fitted inside the cavity of a second U-shaped bracket 16 having two substantially parallel sides 36 and 38 connected by a substantially perpendicular base side 40. A wedge 42 is positioned between the base 40 of the second U-shaped bracket 16 and the base 30 of the first U-shaped bracket 14. A screw 44 passes through a hole 46 in the side 38 of the second U-shaped bracket 16 and is threaded into the wedge 42. A slot 48 in the first U-shaped bracket 14 ensures that the screw 44 does not contact the first U-shaped bracket. An adjusting knob 22 of screw 44 protrudes from the second U-shaped bracket 16 and provides a convenient means for a skater to adjust the amount of braking force exerted.

Figure 3:
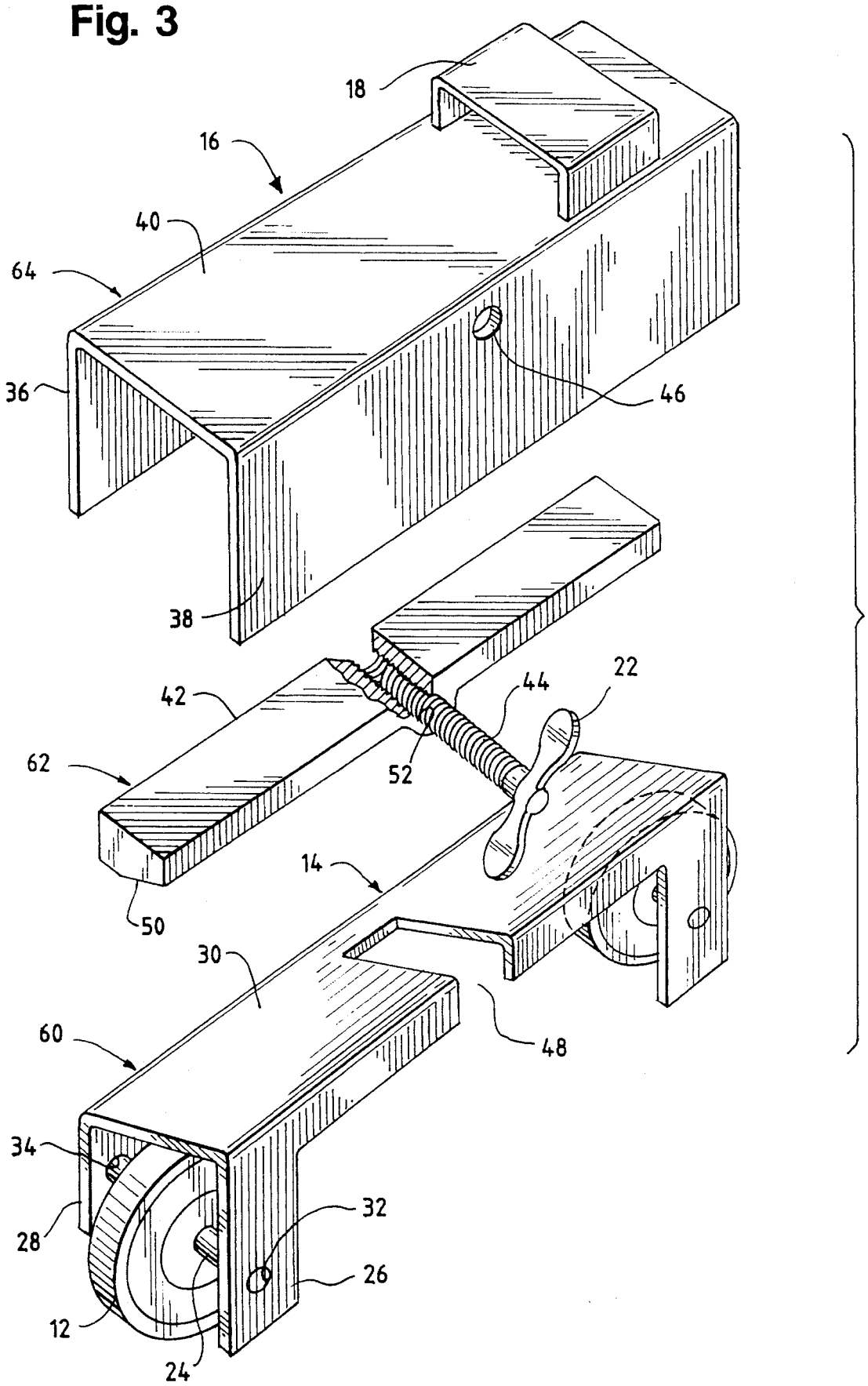
FIG. 3 is an exploded view of the brake shown in FIG. 2.

FIG. 3 is an exploded view of the braking apparatus shown in FIG. 2. A braking member support assembly 60 includes a first U-shaped bracket 14 having two sides 26 and 28 and a slanted base side 30. A braking member 12 is rotationally mounted on an axle 24 which is in turn rotationally mounted to the first U-shaped bracket 14 via holes 32 and 34. A second braking member is mounted in a similar manner at the opposite end of the first U-shaped bracket 14. A slot 48 is cut in the base 30 so that a screw 44 does not contact the first U-shaped bracket 14.

An adjusting knob support structure 62 includes a wedge 42 with a slanted side 50. A screw 44 with an adjusting knob 22 is threaded into a hole 52 of the wedge 42. Hole passes completely through the wedge 42 to permit the screw 44 to exit the opposite side of the wedge 42. However, as will be appreciated by those of ordinary skill in this field, any manner of attaching the screw 44 that permits the wedge 42 to be movable is within the scope of the invention.

A housing bracket 64 is formed from a second U-shaped bracket 16 having a base side 40 and two sides 36 and An arch support 18 is attached to the base 40 and aids the braking device 11 in fitting properly along the bottom of the boot 4 of an in-line skate 2 (not shown). The screw 44 of the adjusting knob support structure 62 fits through a hole 46 in the side 38 of the housing bracket When the screw 44 is tightened, it exits from the opposite side of wedge 42 and contacts the side 36 of the second U-shaped bracket 16. When the screw 44 is further tightened, the wedge 42 is drawn to the right via the threads on screw 44. The wedge 42 thus slides to the right across the base 30 of the first U-shaped bracket of the braking member support assembly 60. The slanted nature of base 30 forces the first U-shaped bracket downward, increasing the braking force exerted by the braking device 11 on the wheels 8 of the in-line skate 2. Alternatively, it is recognized that the screw 44 could be rotationally attached to the wedge 42 and threaded through hole 46. According to this embodiment, turning the screw 44 would move the wedge 42 left or right via the interaction of the screw 44 and the threads in hole 46.

The infinitely adjustable removable braking apparatus of the present invention may be included with in-line skates as they are sold. The invention may also be sold separately because it is completely self-contained and can be mounted on in-line skates by the user.

In operation, a skater adjusts the degree of braking pressure applied to the wheels of a pair of in-line skates by the braking apparatus 11 of the present invention by turning the adjusting knob 22. As described above, the adjusting knob 22 operates to control the force exerted by the braking members 12 against the wheels 8 of the in-line skates 2. Greater force between the braking members 12 and the wheels 8 retards the ability of the wheels 8 to turn. This makes the in-line skates 2 more maneuverable to the beginning skater and reduces his chances of falling. As the skater improves, the infinite adjustability of the braking apparatus 11 allows the skater to control the precise amount of force exerted between the braking members 12 and the wheels 8. In other words, the skater has an infinite degree of control over the maneuverability of the in-line skates 2 because of the braking apparatus 11 of the present invention. As the skater improves, he will desire to incrementally lessen the force between the braking members 12 and the wheels 8 to allow the wheels 8 to rotate more freely. When the skater becomes sufficiently comfortable with the in-line skates, the braking apparatus 11 is easily removed.

While the present invention has been described with reference to one or more particular embodiments, those skilled in the art will recognize that many changes may be made thereto without departing from the spirit and scope of the present invention, which is set forth in the following claims.

What is claimed is:

1. A self-aligning braking device for use in an in-line roller skate, said in-line skate having a wheel support structure and at least three wheels, each of said wheels having an axis of rotation, said braking device comprising:

at least two braking members, each of said braking members having a braking surface;

a first structure connected to said braking members which positions said braking members relative to said wheels of said skate, said braking surfaces of said braking members engaging and exerting pressure on at least two of said wheels;

a second structure movable relative to said first structure to vary the pressure exerted by said braking members on at least two of said wheels of said in-line skate;

said first structure comprises an axle for each of said braking members, a first U-shaped bracket having said axles of said braking members mounted thereto and a second U-shaped bracket fitting within said wheel support structure, said first U-shaped bracket being positioned for relative movement within said second U-shaped bracket; and said second structure comprises a wedge and a screw, said wedge being positioned between said first U-shaped bracket and said second U-shaped bracket, said screw rotatably engaging said wedge, said wedge being laterally displaced by rotation of said screw, said first U-shaped bracket and said second U-shaped bracket each having a base side, a lateral displacement of said wedge varying the distance between said base sides of said first U-shaped bracket and said second U-shaped bracket to vary the pressure exerted by said braking members on said at least two of said wheels of said in-line skate.

2. A self-aligning braking device for use in an in-line roller skate, said in-line skate having a wheel support structure and at least three wheels, each of said wheels having a circumference and an axis of rotation, said braking device comprising:

at least two braking members, each of said braking members having a braking surface;

means for positioning said braking members relative to said wheels of said skate, said means for positioning allowing said braking surface of said braking members to engage the circumference of at least two of said wheels, said braking members exerting pressure on said at least two of said wheels when said braking members engage said at least two of said wheels:

means for varying the pressure exerted by said braking members on said wheels of said in-line skate:

said means for positioning comprises an axle for each of said braking members, a first U-shaped bracket having said axles of said braking members mounted thereto and a second U-shaped bracket fitting within said wheel support structure, said first U-shaped bracket being positioned for relative movement within said second U-shaped bracket; and said means for varying the pressure comprises a wedge and a screw, said wedge being positioned between said first U-shaped bracket and said second U-shaped bracket, said screw rotatably engaging said wedge, said wedge being laterally displaced by rotation of said screw, said first U-shaped bracket and said second U-shaped bracket each having a base side, a lateral displacement of said wedge varying the distance between said base sides of said first U-shaped bracket and said second U-shaped bracket to vary the pressure exerted by said braking members on said at least two of said wheels of said in-line skate.

3. A braking assembly for a roller skate, said roller skate having a wheel support structure and two or more wheels, each of said wheels having an axis of rotation, said braking device comprising:

at least one braking member having a braking surface;

a first structure for positioning said braking member relative to the wheels of said skate, said braking surface of said braking member engaging at least one of said wheels, said braking member exerting pressure on said at least one of said wheels when said braking member engages said at least one of said wheels;

a second structure for varying the pressure exerted by said braking member on said at least one of said wheels of said skate;

said first structure comprises an axle for said at least one braking member, a first U-shaped bracket having said axle of said at least one braking member mounted thereto and a second U-shaped bracket fitting within said wheel support structure, said first U-shaped bracket being positioned for relative movement within said second U-shaped bracket; and said second structure comprises a wedge and a screw, said wedge being positioned between said first U-shaped bracket and said second U-shaped bracket, said screw rotatably engaging said wedge, said wedge being laterally displaced by rotation of said screw, said first U-shaped bracket and said second U-shaped bracket each having a base side, a lateral displacement of said wedge varying the distance between said base sides of said first U-shaped bracket and said second U-shaped bracket to vary the pressure exerted by said at least one braking member on at least one of said wheels of said roller skate.

* * * * *